US006554125B1

(12) United States Patent
Honegger

(10) Patent No.: US 6,554,125 B1
(45) Date of Patent: Apr. 29, 2003

(54) DEVICE FOR CHANGING THE POSITION OF OBJECTS CONVEYED IN AN OVERLAPPING STREAM

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/582,118

(22) PCT Filed: Dec. 29, 1998

(86) PCT No.: PCT/CH98/00561

§ 371 (c)(1),
(2), (4) Date: Aug. 23, 2000

(87) PCT Pub. No.: WO99/35072

PCT Pub. Date: Jul. 15, 1999

(30) Foreign Application Priority Data

Dec. 30, 1997 (CH) ..... 2986/97

(51) Int. Cl.[7] ..... B65G 43/00; B65G 47/26; B65G 47/31

(52) U.S. Cl. ..... 198/460.1; 198/461.2; 198/461.3; 271/271; 271/277

(58) Field of Search ..... 271/271, 277, 271/204; 198/460.1, 461.2, 461.3

(56) References Cited

U.S. PATENT DOCUMENTS 3,955,667 A * 5/1976 Muller et al.
4,201,286 A * 5/1980 Meier
4,333,559 A * 6/1982 Reist
4,550,822 A * 11/1985 Meier
4,667,950 A 5/1987 Linder et al.
4,905,981 A 3/1990 Reist
5,669,604 A 9/1997 Hansen

FOREIGN PATENT DOCUMENTS

| | | | |
|---|---|---|---|
| CH | 631 410 | A5 | 8/1982 |
| CH | 677778 | A5 | 6/1991 |
| DE | 3903610 | A | 9/1989 |
| EP | 0254851 | A | 2/1988 |
| GB | 2089329 | A | 6/1982 |
| WO | WO 9503989 | A | 2/1995 |

* cited by examiner

*Primary Examiner*—D. Glenn Dayoan
*Assistant Examiner*—Scott Carpenter
(74) *Attorney, Agent, or Firm*—Alston & Bird LLP

(57) ABSTRACT

An apparatus for changing the position of flexible flat objects, in particular printed products, as they are advanced on a first conveyor in an overlapping stream, and which includes a position changing device positioned above the first conveyor and which comprises a displacement member which is moved along a movement path by means of a drive. The movement path includes one section which extends rectilinearly and in the conveying direction and the displacement member is driven at a speed which corresponds at least approximately to the conveying speed of a second conveyor toward which the displacement member conveys the objects. The second conveyor delivers the objects to a discharge conveyor which is provided with transport clamps which are delivered individually to a fitting point where they receive an object from the second conveyor.

9 Claims, 4 Drawing Sheets

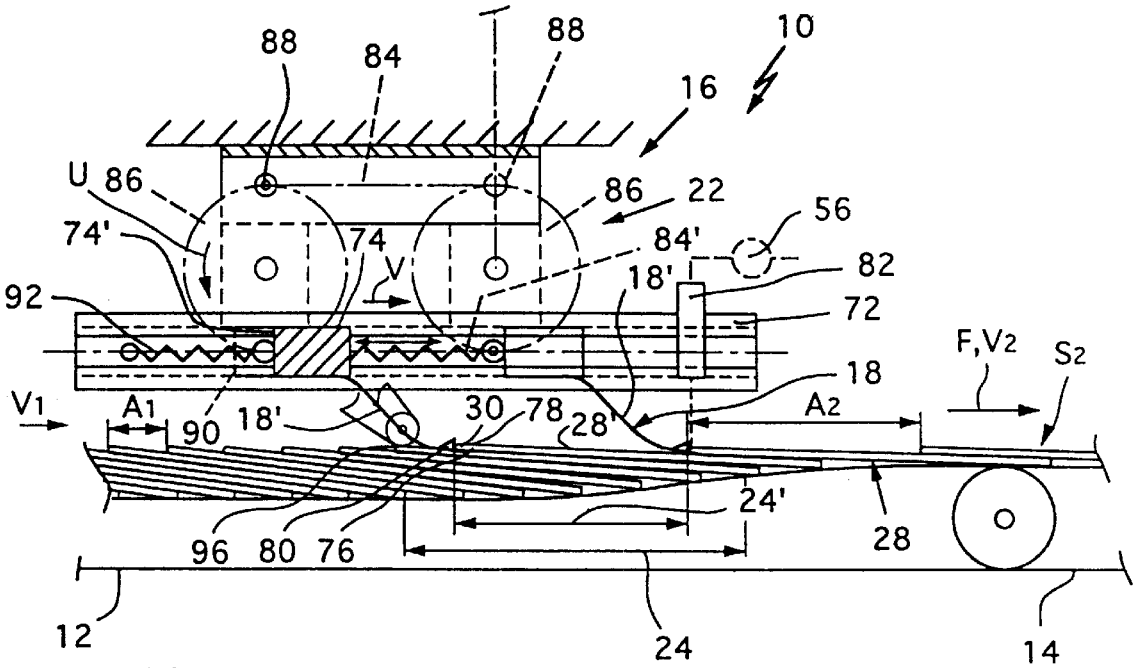
Fig.4
Fig.3
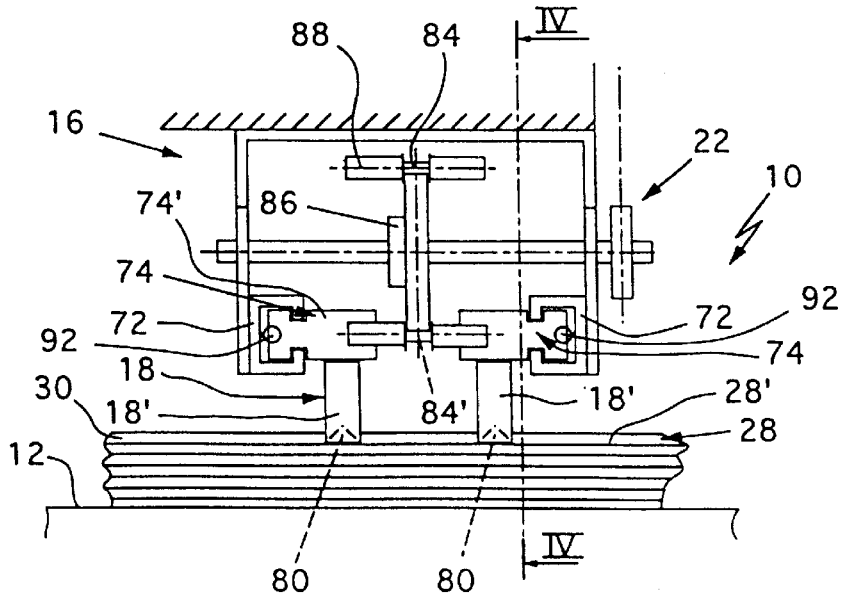

DEVICE FOR CHANGING THE POSITION OF OBJECTS CONVEYED IN AN OVERLAPPING STREAM

BACKGROUND OF THE INVENTION

The present invention relates to an apparatus for changing the position of flexible, flat objects, in particular printed products, arriving on a first conveyor in an overlapping stream.

An apparatus of this type is disclosed by CH Patent Number 677 778. Arranged in the downstream end region of a first conveyor, between the conveyor tapes forming a conveying plane, is a position-changing device. It has two disks which are arranged beside each other in the conveying plane and driven in opposite directions, on each of which a displacement cam is situated eccentrically. These displacement cams are intended in each case to come into contact with the rear edge of each object arriving on the first conveyor in an overlapping stream, to accelerate said object in the conveying direction and to feed it to the second conveyor. The latter is assigned a braking device, which is intended to brake the objects accelerated by the rotation of the disks to the conveying speed of the second conveyor. The high speeds and retardations associated with this apparatus, in particular in the case of a high processing capacity, constitute a considerable stress on the objects, and can lead to damage. Furthermore, in order to achieve a specific desired spacing between the objects on the second conveyor, the distance of the displacement cams from the axes of rotation of the disks, and the rotational speed of the disks, depend on one another and also on the conveying speeds of the first and second conveyors, the desired spacing and the spacing of the objects in the arriving overlapping formation, for which reason rather closer limits are placed on the ability of the apparatus to be used.

In a further apparatus, which is disclosed in CH 631 410 and is connected between a first and a second conveyor, printed products are conveyed using displacement means which are fixed to a toothed chain and are provided with contact rollers, which are driven in the opposite direction to the direction of motion of the displacement means. The printed products are therefore not gripped immediately by the displacement means but only during the transfer between the first and the second conveyor. The duration of the synchronization procedure depends on the printed products, so that universal use of the apparatus is called into question.

The published specification WO 95/03989 discloses a further apparatus in which printed products are transferred from a first to a second conveyor. The second conveyor has a chain, on which transport clamps are firmly mounted at equal intervals from one another. The transport clamps are therefore filled periodically with a printed product at a transfer point. A position-changing device is provided to ensure that the printed products in each case arrive at the second conveyor at the correct time. The requirements on the first conveyor and the preceding conveying systems are therefore very high, so that if there are irregularities in the feed, disruptions can easily occur.

It is therefore an object of the present invention to develop the apparatus of known type in such a way that it can be used more universally, with more careful handling of the objects.

SUMMARY OF THE INVENTION

The above and other objects and advantages of the present invention are achieved by the provision of an apparatus for changing the position of the objects arriving on a first conveyor, for example, in an overlapping stream, and which comprises a position changing device arranged in the region of the first conveyor and which has a displacement means which is moved along a movement path. During at least one section of the movement path, the displacement means is driven by means of a drive at a higher speed than the conveying speed of the first conveyor and so as to feed each object delivered to the position changing device to a second conveyor, which is driven at a conveying speed that is higher than that of the first conveyor. The one section of the movement path extends at least approximately rectilinearly and in the conveying direction, and the drive drives the displacement means in the one section at a speed which is at least approximately equal to the conveying speed of the second conveyor.

The at least approximately rectilinear movement path of the displacement means permits the speed of the objects to be kept low; it never needs to be higher than the conveying speed of the second conveyor, which permits high processing capacities with careful handling of the object.

BRIEF DESCRIPTION OF THE DRAWINGS

The invention will now be explained in more detail with reference to exemplary embodiments illustrated in the drawing, in which, in purely schematic form:

FIG. 3 shows a front view of a third embodiment of the apparatus according to the invention;

FIG. 4 shows, in a section along the line IV—IV in FIG. 3, the embodiment shown there of the apparatus according to the invention;

DETAILED DESCRIPTION OF THE PREFERRED EMBODIMENTS

Figure 1:
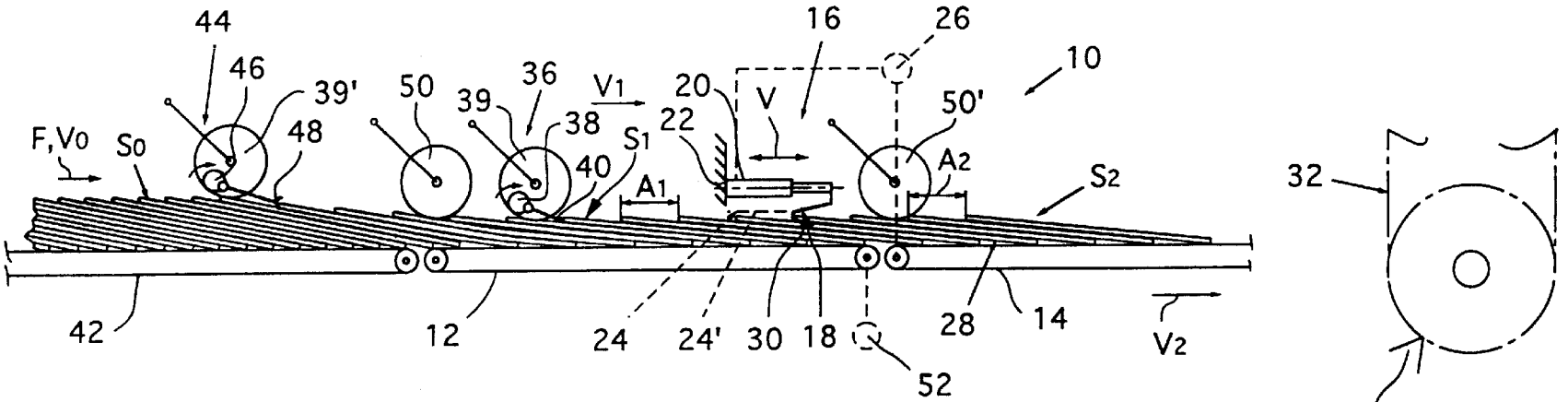
FIG. 1 shows a side view of part of a device for feeding objects arriving in an overlapping stream to a discharge conveyor, the device for matching the overlapping stream to the requirements of the discharge conveyor having, inter alia, a first embodiment of an apparatus according to the invention.

The apparatus 10 shown in FIG. 1 has a first belt conveyor 12 which is driven in the conveying direction F at a first conveying speed $v_1$. Connected immediately downstream of said first belt conveyor is a second belt conveyor 14, which is driven in the conveying direction F at a second conveying speed $v_2$ which is higher than the first conveying speed $v_1$.

Arranged above the first belt conveyor 12 is a position-changing device 16. It has a displacement means 18 of hook-like design, which can be moved, by means of a drive 22 designed as a cylinder/piston unit 20, in and counter to the conveying direction F, along a rectilinear movement path 24. As indicated with dashed lines, the cylinder/piston unit 20 is connected to a control device 26, which is influenced by the conveying speed $v_2$ of the second belt conveyor 14.

Flexible, flat objects 28, printed products in the present case, arrive on the first belt conveyor 12 in an overlapping formation $S_1$, in which each object 28 rests on the respectively following object. The spacing between the rear edges 30 of successive objects 28 is designated by $A_1$. It can be subject to considerable scatter. The position-changing device 16 is intended to act positively, with the displacement means 18, on the rear edge 30 of each object 28 fed by the first belt conveyor 12, and to feed it in the conveying direction F to the second belt conveyor 14 in such a way that the rear edges 30 of successive objects 28 are spaced apart from one another by a desired spacing $A_2$ in the overlapping formation $S_2$. For this purpose, the drive 22 is operated at a frequency f which is given by the quotient of the second conveying speed $v_2$ and the desired spacing $A_2$. During a displacement stroke in the conveying direction F, the displacement means 18 is accelerated, in a short acceleration section of the movement path 24, to a speed v which corresponds to the second conveying speed $v_2$, is then moved onward at this speed in a section 24' of the movement path and braked in a braking section, which is again short. The downstream end of the section 24' of the movement path is arranged at a distance from the second belt conveyor 14 such that the object 28 respectively fed by the position-changing device 16 is carried along by the second belt conveyor 14 when the displacement means runs into the braking section.

A discharge conveyor 32 is connected downstream of the second belt conveyor 14, as indicated by dash dotted lines. It has transport clamps 34 which are arranged one behind another and are intended in each case to pick up an object 28 from the second belt conveyor 14 and convey it away. The second conveying speed $v_2$, the desired spacing $A_2$ and the phase angle of the objects 28 on the second belt conveyor 14—and thus the position-changing device 16—are coordinated with the discharge conveyor 32 in such a way that each transport clamp 34 is fed one object 28.

Arranged upstream of the position-changing device 16, above the first belt conveyor 12, is a counting device 36. Arranged on a counting drive 38 is a counting element 40, which is intended to be placed on the rear edge 30 of each object 28, in order, for each object 28, to emit a counting signal to a counter. A pressing roller 39 prevents objects 28 moved in the conveying direction by the counting element 40 being able to carry along the respectively following object by means of friction, if need be. Particularly preferred embodiments of the counting device 36 are disclosed in U.S. Pat. Nos. 6,363,133; 6,349,125; and 6,359,954. The disclosures of these patents are incorporated by reference in the present application.

Connected upstream of the first belt conveyor 12 is a feed conveyor 42, likewise constructed as a belt conveyor. Arranged above the feed conveyor 42 is a device 44 for pulling apart the objects 28 arriving on the feed conveyor 42 in a closely packed, overlapping formation $S_0$. It has a striking element 48 which is arranged on a striking drive 46 and is intended to be placed on the rear edge 30 of each object 28 fed in the overlapping formation $S_0$ and to feed said object to the first belt conveyor 12 at a speed which is higher than the conveying speed $v_0$ of the feed conveyor 42. At the same time, a weighted roller 39' prevents the following object 28 being carried along by friction. The conveying speed $v_0$ of the feed conveyor 42 is lower than the conveying speed $v_1$ of the first belt conveyor 12. In order to ensure that the objects 28 fed to the first and second belt conveyors 12, 14 are carried along, weighted rollers 50 and 50' interact with these belt conveyors in the upstream starting area. A further preferred embodiment of the device 44 is disclosed in U.S. Pat. No. 6,363,133.

The apparatus shown in FIG. 1 operates as follows. In the case of a position-changing device 16 which is synchronized with the discharge conveyor 32, and a synchronized second belt conveyor 14, a drive unit 52 for the first belt conveyor 12 is adjusted in such a way that each object 28 is caught individually by means of the displacement means 18 and fed to the second belt conveyor 14 in correct phase and with the required spacing $A_2$. The feed conveyor 42, the counting device 36 and the device 44 are coordinated with the speed of the drive unit 52, which ensures that the objects 28 arriving in the overlapping formation So are at least pushed apart to the necessary spacing Al and are counted.

Figure 2:
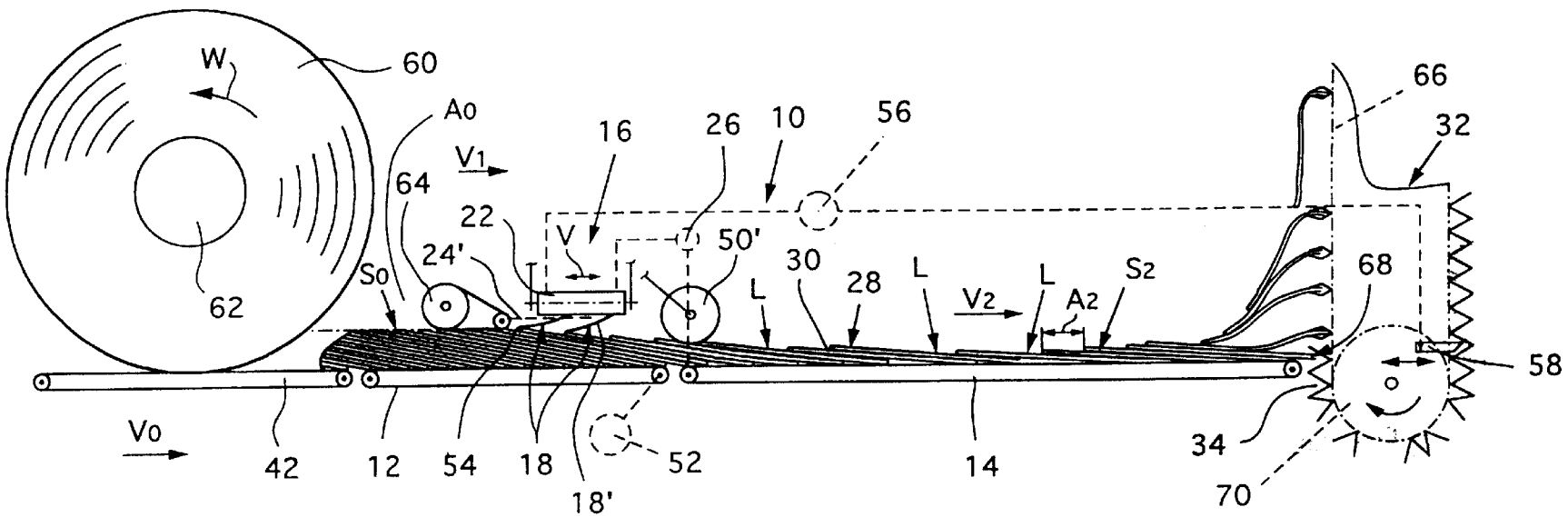
FIG. 2 shows, likewise in side view, a device for feeding objects arriving in an overlapping stream to a discharge conveyor having a second embodiment of the apparatus according to the invention.

In the case of the apparatus 10 shown in FIG. 2, the displacement means 18 has two displacement elements 18' driven in antiphase. The control device 26 controls the drive 22 of the displacement elements 18' in such a way that, at the cycle rate of the second belt conveyor—this is given by the quotient of the desired spacing $A_2$ and the second conveying speed $v_2$—in each case a displacement element 18' is located at the downstream end of the section 24' of the movement path. Each displacement element 18' is assigned a sensor element 54 which, when the relevant displacement element 18' interacts in each case with the rear edge 30 of an object 28, emits a signal to a counter 56 and to a release device 58 of the discharge conveyor 32 connected downstream of the second belt conveyor 14.

A feed conveyor 42 is again connected upstream of the first belt conveyor 12, and its conveying speed $v_0$ corresponds to the conveying speed $v_1$ of the first belt conveyor 12. The latter rests in an undershot manner on a coil 60. The objects 28 wound onto a winding core 62 in a closely packed, overlapping formation $S_0$ are unwound from said coil 60, together with a winding tape under tension. As viewed in the unwinding direction W, in the overlapping formation $S_0$, each object rests on the respectively following object with a small spacing $A_0$ between the rear edges 30.

The drive unit 52 for the first belt conveyor 12, the feed conveyor 42 and the coil 60 is coordinated with the drive 22 of the position-changing device 16 in such a way that the displacement capacity of the position-changing device 16 is approximately 20% higher than the capacity with which the objects 28 are fed to the position-changing device 16. Since the displacement elements 18' are driven at a higher frequency than the objects 28 arrive, not every displacement element 18' displaces an object 28 into the active region of the second belt conveyor 14 with every delivery stroke in the conveying direction F. As a result, gaps L appear in the overlapping stream $S_2$ as a result of missing objects 28, but because of the synchronization between the second belt conveyor 14 and the position-changing device 16, it is ensured that the spacing between the rear edges 30 of successive objects 28 always corresponds to the desired spacing $A_2$ or an integer multiple thereof.

For completeness, it should be mentioned that again a weighted roller 50' interacts with the second belt conveyor 14, and a retaining device 64 equipped with an endless belt—carrying out the same function as the weighted rollers 39 and 39'-interacts with the first belt conveyor 12 upstream of the position-changing device 16, in order to prevent objects 28 being carried along by objects 28 moved by the displacement means 18.

The discharge conveyor 32 has individually moveable transport clamps 34 which are arranged one behind another in a guide 66. Directly before the pick-up point 68 at the downstream end of the second belt conveyor 14, the guide 66 runs around a drive wheel 70 which, as indicated by dash-dotted lines, has a drive coupling to the second belt conveyor 14. The drive wheel 70 has catching elements at regular intervals on the circumference for the transport clamps 34. Positioned immediately upstream of the drive wheel 70 is the release device 58. Since the release device 58 in each case releases a transport clamp 34 only upon a signal from the counter 56, it is ensured that each transport clamp 34 is fed an object 28. This is indicated by the fact that, corresponding to the gaps L in the overlapping formation $S_2$, catching elements of the drive wheel 70 are not occupied by a transport clamp 34. This extremely simple control merely makes it necessary that, between the release device 58 and the pick-up point 68, an equal number or more transport clamps 34—in this case the release device will be controlled in an appropriately delayed manner—will find space when there are objects 28 at the desired spacing $A_2$ between the position-changing device 16 and the pick-up point 68. At or downstream of the pick-up point 68, the transport clamps 34 occupied by an object are coupled, for example magnetically, to a drive element which is moved, at least in some sections, along the guide 66, and conveyed away from the pick-up point 68. A particularly suitable embodiment of the discharge conveyor 32 is disclosed in the earlier CH Patent Application Number 1997 2963/97 and the corresponding U.S. patent application Ser. No. 09/554,546.

Since gaps L are permissible in the device shown in FIG. 2, the requirements on the regulation of the drive unit 52 for the first belt conveyor 12 and the coil 60 are low. It is merely necessary to ensure that, in the case of a permissible minimum spacing $A_0$ in the closely packed, overlapping formation $S_0$, a maximum permissible first conveying speed $v_1$ is not exceeded.

The possibility of the independent adjustment of the speed, the stroke and the frequency with which the displacement means are moved, permit great flexibility.

A particularly preferred embodiment of the position-changing device 16, such as is advantageously used in the device shown in FIG. 2, is illustrated in FIGS. 3 and 4. It has two guide rails 72 which are arranged in parallel and extend in the conveying direction F. Guided in each guide rail 72 is a slide 74, to which a self-sprung displacement element 18', for example produced from spring steel, is fastened at one end. The displacement element 18', which projects beyond the relevant slide 74 in the conveying direction F, is constructed in its free, leading end region as an insertion tongue 76, which is provided with a reflector element 78 on its side facing away from the first belt conveyor 12. At the end of the insertion tongue 76 which faces the slide 74, the displacement element 18' has a displacement cam 80. The insertion tongue 76 is intended to rest with prestress on that flat side 28' of the objects 28 which faces it, and to be inserted at the rear edge 30 of an object 28 in order to displace it. At the downstream end of the section 24' of the movement path of each reflector element 78, and thus of the displacement element 18', a light-source/light-sensor unit 82 connected to the counter 56 (FIG. 2) is arranged in a fixed position. If, therefore, the reflector element 78 is covered by an object 28, the light barrier formed by the light-source/light-sensor unit 82 and the reflector element 78 is interrupted, which means that during the corresponding delivery stroke of the displacement element 18', an object 28 is fed to the second belt conveyor 14. If, on the other hand, the light barrier is not interrupted, this means that the displacement element 18' is not moving an object 28.

The drive 22 for the displacement elements 18' has an intrinsically self-contained traction element 84, for example formed by a chain. It is lead around two turn wheels 86 in such a way that the conveying run 84' extends in the conveying direction F between the guide rails 72. Catching cams 88 project on alternate sides from the traction element 84 at the desired spacing $A_2$ for the objects 28. When the traction element 84 is driven in the circulating direction U, the catching cams 88 in each case come into contact with the upstream end 74' of the slides 74, which are located in the rest position 90, and carry said slides 74 along in the conveying direction F until the end of the movement path 24 is reached, where the catching cams 88 run off the end 74' because of the deflection around the downstream turn wheel 86. The speed v, at which the catching cams 88 are driven, corresponds to the second conveying speed $v_2$. In the acceleration section of the movement path 24 between the rest position 90 of the slides 74, in which they are held by means of a tension spring 92, and the position of the axis of the upstream turn wheel 86, the slide 74 is accelerated to the second conveying speed $v_2$. In the section 24' of the movement path, which extends over a length corresponding to the spacing between the axes of the two turn wheels 86, it maintains this speed. From the position of the axis of the downstream turn wheel 86 until the relevant catching cam 88 runs onto the end 74', the slide 74 is retarded, and after running off slides back again into the rest position 90 because of the force of the tension spring 92.

In FIG. 4, a slide 74 is also shown at the downstream end of the section 24' of the movement path, from where the relevant object 28 is in each case conveyed onward by the second belt conveyor 14. The design shown of the position-changing device 16 has the advantage that the displacement elements 18' do not have to be pivoted out of the region of the objects 28, which ensures very precise positioning and transfer of the objects to the second belt conveyor 14. Since the displacement elements 18' sweep over objects 28 in their rest position and during their movement counter to the conveying direction F, they do not need to be pivoted into the movement path 24 of the objects 28 for the movement in the conveying direction and in order to act on the objects 28. They interact with the objects 28 in the manner of a free-wheel. This leads to each object being carried along reliably.

As can be seen from FIG. 4, the length of the section 24' of the movement path corresponds to the desired spacing $A_2$, but can also be different. Here, too, the first conveying speed $v_1$ is coordinated with the second conveying speed $v_2$ in such a way that two objects 28 are certainly never caught by the displacement elements 18' and fed to the second belt conveyor 14.

The conveying tapes, arranged beside one another, of the first belt conveyor 12 consist of resilient material, so that in the presence of objects 28 a sag can be formed between said tapes and a reference 96 matched to the insertion tongues 76. The object 28 to be caught in each case by a displacement element 18' therefore rests approximately parallel to the guide rails 72 and the conveying plane of the second belt conveyor 14.

Figure 5:
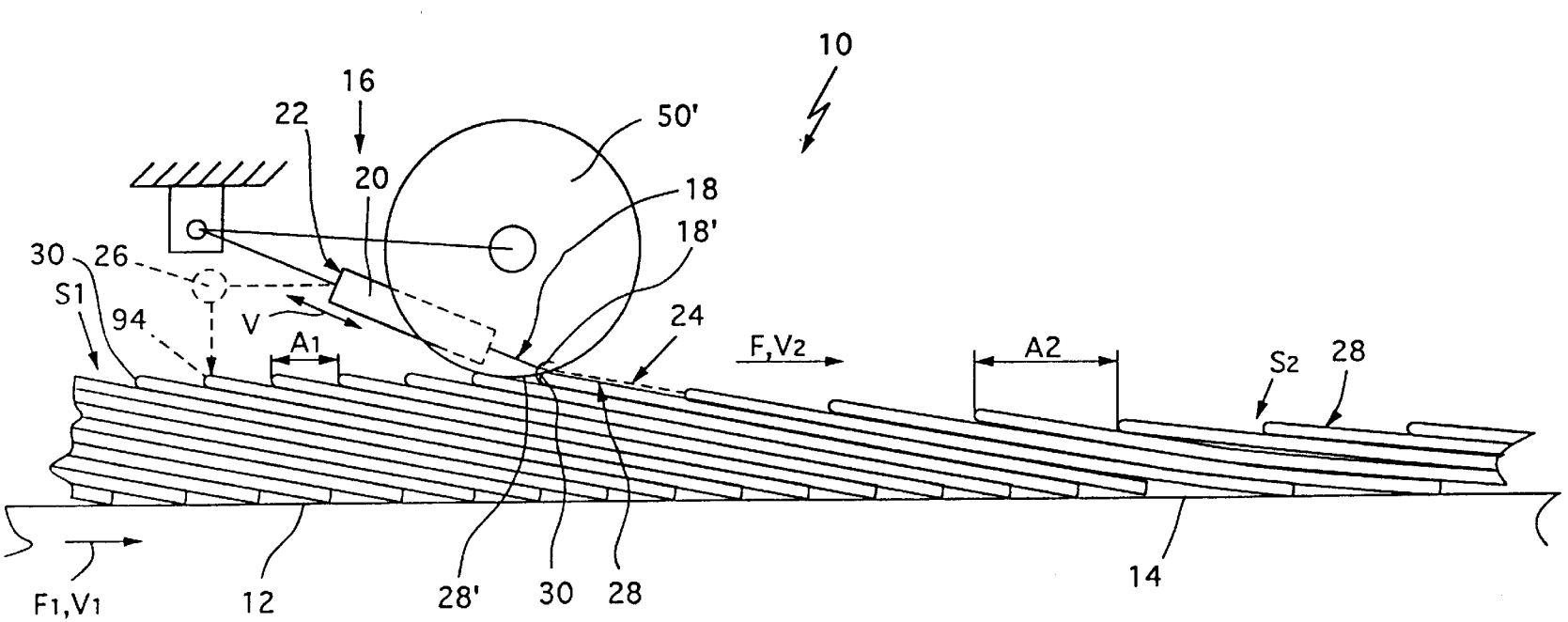
FIG. 5 shows a side view of a fourth embodiment of the apparatus according to the invention.

A further embodiment of the position-changing device 16 is shown in FIG. 5. The drive 22 is constructed as a cylinder/piston unit 20, which is mounted in a fixed position at one end and provided at the other end with a displacement element 18'. The cylinder/piston unit 20 is connected to a control device 26 which, for its part, is connected to a sensing device 94 for the rear edges 30 of the objects 28 arriving on the first belt conveyor 12 in the overlapping formation $S_1$. The displacement element 18' is intended to rest on the flat side 28' of the objects 28. The control device 26 controls the cylinder/piston unit 20 as a function of the desired spacing $A_2$ to be achieved, the second conveying speed $v_2$ and the signals from the sensing device 94. In this case, the movement path 24 is defined by the flat side 28' of the objects 28. A weighted roller 50' prevents the upstream objects 28 being carried along in relation to the displacement element 18'.

Figure 6:
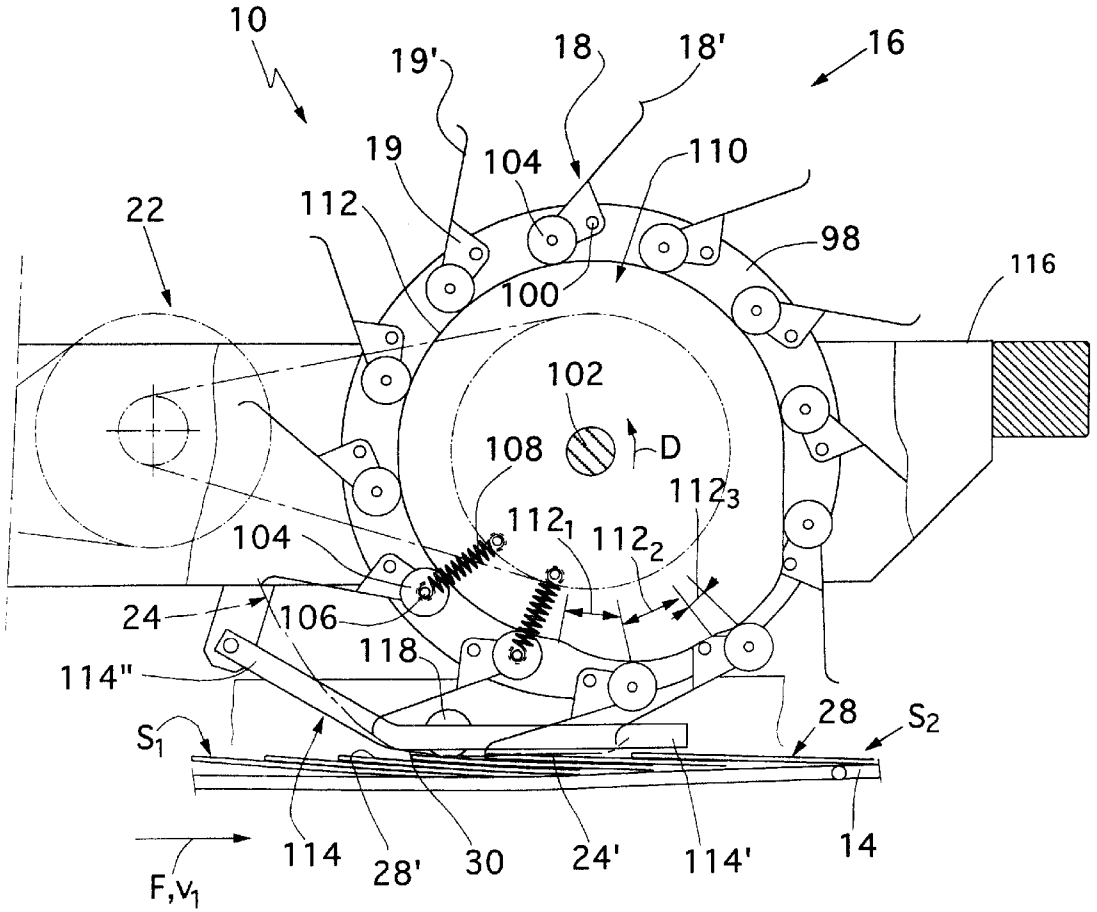
FIG. 6 shows a side view of a fifth embodiment of the apparatus according to the invention.
Figure 7:
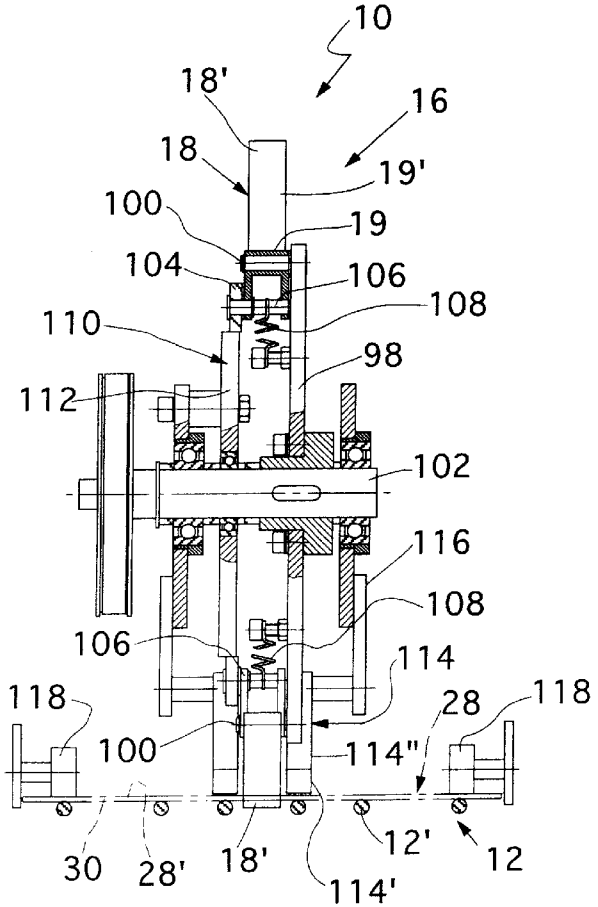
FIG. 7 shows, in front view and partly sectioned, the apparatus shown in FIG. 6.

FIGS. 6 and 7 show a further embodiment of the position-changing device 16, in which the displacement means 18 has twelve displacement elements 18'. These are constructed like double levers and, with their bearing part 19 of U-shaped cross section, are pivotably mounted on bearing shafts 100 protruding from a carrying disk 98. The bearing shafts 100 extend parallel to a drive shaft 102, on which the carrying disk 98 is seated such that it rotates with it, and are arranged to be uniformly distributed in the circumferential direction on a circle which is concentric with the drive shaft. Fixed to each of the bearing parts 19 is a bow 19', which is produced from a spring-steel strip and is bent like a hook at its free end. By means of a drive 22, the carrying disk 98 is driven in rotation in the direction of rotation D in a manner coordinated with the conveying speed $v_2$ of the second belt conveyor 14 connected downstream of the first belt conveyor 12. The bearing parts 19 of the displacement elements 18' each bear a freely rotatably mounted follower roller 104. One end of a tension spring 108 acts on the bearing pin 106 of each follower roller 104, and the other end, as viewed in the radial direction, is fixed further in to the carrying disk 98. The tension springs 108 hold the follower rollers 104 in contact with the circumference of a fixedly arranged control disk 110. The circumference of the control disk 110 forms a control cam 112 for the pivoting position of the displacement elements 18'.

The tapes 12' which form the first belt conveyor 12 and which are produced from resilient material run underneath the position-changing device 16. They are driven in the conveying direction F at the first conveying speed $v_1$. They are intended to feed the flat objects 28 arriving in an overlapping formation $S_1$ to the position-changing device 16. In the overlapping formation $S_1$, each object 28 rests on the respectively following object, as a result of which the rear edge 30 of each object 28 is exposed in the upward direction.

Arranged above the first belt conveyor 12 and underneath the carrying disk 98 are two hold-down elements 114, which are fixed to the machine frame 116, on which the drive shaft 102 is freely rotatably mounted and to which the control disk 110 is also fixed. The hold-down elements 14, which are arranged on both sides of the movement path 24 of the displacement elements 18', have a rectilinear guide section 114' which extends in the conveying direction F, and an upstream inlet section 114" arranged at an obtuse angle thereto. The hold-down section 114', against which the objects 28 are kept in contact by the resilient design of the first belt conveyor 12, defines the movement path of the rear edges 30 of the objects 28. The inlet section 114', together with the first belt conveyor 12, forms an inlet which tapers like a wedge into the gap formed by the tape 12' and the hold-down section 114".

As viewed in FIG. 6, from about three o'clock—in the counterclockwise direction—to about six o'clock, that is to say vertically underneath the drive shaft 102, the control cam 112 runs concentrically with the drive shaft 102. Here, the corresponding displacement elements 18' assume a position in relation to the circular carrying disk 98 in which the hook-like end trails in relation to the follower roller 104, and the displacement elements 18 approximately form an angle of 45° with an associated tangent to the carrying disk 98. Approximately vertically underneath the drive shaft 102, as viewed in the direction of rotation D, there begins a cam section $\mathbf{112}_1$, in which the distance from the drive shaft 112 increases continuously. This is adjoined by an approximately equally long section $\mathbf{112}_2$, in which the distance becomes smaller again. Arranged immediately after this is a section $\mathbf{112}_3$, in which the distance increases again within a small angular range. In a region which follows the section $\mathbf{112}_3$, the distance remains unchanged again, decreases again in a region between about four o'clock and three o'clock and becomes the same as the radius of the concentric section.

This form of the control cam 112 has the following action. As, as viewed in the direction of rotation D, a follower roller 104 approaches the section $\mathbf{112}_1$ of the control cam, the hook-like end of the displacement element 18' moves through between the hold-down elements 114 in the inlet section 114" and comes into contact with its free end on the upper flat side 28' of an object 28. As a result, the hook-like end of the displacement element 18' is forced back resiliently, but holds the tension spring 108 and the follower roller 104 in contact with the control cam 112. The start of the hold-down section 114' coincides approximately with the region in which the displacement element 18' comes into contact with the respective object 28. The result of the section $\mathbf{112}_1$ of the control cam 112 is that the hook-like end of the displacement means 118 moves along the section 24' of the movement path, which extends at least approximately rectilinearly and in the conveying direction F. For this purpose, the displacement element 18' is pivoted in the clockwise direction. Since the circumferential speed of the hook-like end of the displacement element 18' is higher than the first conveying speed $v_1$, the displacement element 18' comes into contact with the rear edge 30 of the leading object 28 and carries the latter along in the conveying direction F. In the section $\mathbf{112}_2$ of the control cam 112, the relevant displacement element 18' is pivoted in the counter-clockwise direction, the result of which is that, on the one hand, the hook-like end of the displacement element 18' continues to be moved along the at least approximately rectilinear section 24' of the movement path and, on the other hand, the trailing hook-like end of the displacement element 18' experiences an acceleration, as viewed in the conveying direction F. As far as the downstream end of the section $\mathbf{112}_2$, as viewed in the direction of rotation D, the hook-like end of the displacement element 18', as viewed in the conveying direction F, is accelerated to the second conveying speed $v_2$ of the second conveyor 14, the result of which is that the object 28 displaced in the conveying direction F by the relevant displacement element 18' is fed to the second conveyor at the desired second conveying speed $v_2$ and at the correct phase angle. The result of the third section $\mathbf{112}_3$ is that the displacement element 18' is pivoted in the clockwise direction, in order to move its hook-like, trailing end inward in the radial direction away from the rear edge 30 of the object 28 displaced forward. This and the following section prevent the displacement element 18' acting further on objects 28.

In this embodiment, the spacing $A_2$ to be achieved between the rear edges 30 of successive objects 28 in the overlapping formation $S_2$ formed is defined by the spacing of the displacement elements 18' on the carrying disk 98. This embodiment is distinguished by particularly quiet running, even at very high processing capacity.

The hold-down elements 114 prevent the objects 28 bending up when they are acted on by a displacement element 18'. In addition, hold-down rollers 118 arranged on both sides of the first belt conveyor 12 prevent the objects 28 bending up laterally.

Of course, in this embodiment [sic] can also have a detection device which interacts with the displacement elements 18' and emits a signal to a counting and/or control device in each case when a displacement element 18' interacts with an object 28.

It is preferable if, in all the embodiments, the frequency f at which the displacement means 18 are moved through the movement path 24 is approximately 1.2 to 1.4 times as high as the quotient of the first conveying speed $v_1$ and a permissible minimum spacing $A_1$ between the rear edges 30 of successive objects in the arriving formation $S_0$ or $S_1$. It is further preferred for the second conveying speed $v_2$ to be at least approximately 2 to 4 times as high as the first conveying speed $v_1$. In this case, the quotient of the second conveying speed $v_2$ and the desired spacing $A_2$ is greater than the quotient of the first conveying speed $v_1$ and the minimum spacing $A_1$ in the arriving formation $S_0$ or $S_1$. It is further preferred for the section 24' of the movement path to be at least approximately 2 to 4 times as long as the permissible minimum spacing $A_1$ between the rear edges 30 of successive objects 28 in the arriving formation $S_0$ or $S_1$.

Of course, it is also conceivable for the slides 74, during their movement counter to the conveying direction F brought about by the tension spring 92, to come immediately into contact again with their end 74' with a catching cam 88, so that they are driven again in the conveying direction F immediately—without waiting in the rest position 90.

In particular, the device shown in FIG. 2, preferably in combination with the apparatus illustrated in FIGS. 3 to 7, is also suitable for equipping each object with a transport clamp 34.

What is claimed is:

1. Apparatus for transferring flexible flat objects from a first conveyor to a discharge conveyor which is provided with transport clamps, comprising:

a first conveyor;

a second conveyor positioned immediately downstream of the first conveyor;

a discharge conveyor positioned downstream of the second conveyor, said discharge conveyor having transport clamps arranged one behind another at a release point, a release device at the release point whereby the transport clamps can be selectively released, said discharge conveyor further comprising a drive for the transport of the transport clamps released at the release point to a pick-up point, said drive being synchronized with the second conveyor; and a position changing device which is arranged in the region of the first conveyor, the position changing device being configured to detect arriving objects, to arrange them individually in correct phase on the second conveyor and to emit a signal to control the release device in such a way that, for each object output from the second conveyor, a transport clamp is provided at the correct time by the discharge conveyor for fitting said clamp at the pick-up point with an object fed by the second conveyor.

2. Apparatus according to claim 1, wherein the position changing device is further configured to control the release device such that between the release point and the pick-up point at least an equal number of transport clamps are positioned as there are objects positioned between the position changing device and the pick-up point.

3. Apparatus according to claim 1, wherein the flexible, flat objects arrive on the first conveyor in an overlapping stream, and the position changing device has a displacement means which is moved along a movement path by means of a drive and, at least in one section of the movement path in relation to the conveying direction of the first conveyor, is driven by said drive of the position changing device at a higher speed than the conveying speed of the first conveyor and so as to feed each object delivered to the position changing device by means of the first conveyor to the second conveyor by striking the rear edge of such object, said second conveyor being driven at a conveying speed that is higher than the conveying speed of the first conveyor, and wherein the one section of the movement path extends at least approximately rectilinearly and at least approximately in the conveying direction, and the drive of the position changing device drives the displacement means in the one section of the movement path at a speed which, at least as the objects are transferred to the second conveyor, is at least approximately equal to the conveying speed of the second conveyor.

4. Apparatus according to claim 3, wherein the drive of the position changing device is controlled as a function of the conveying speed of the second conveyor and a desired spacing of the objects on the second conveyor, and such that its phase angle with respect to the second conveyor can be adjusted.

5. Apparatus according to claim 3, wherein a drive element drives the first conveyor in such a way that the quotient of the conveying speed of the second conveyor and the desired spacing is greater than the quotient of the conveying speed of the first conveyor and a minimum spacing between the rear edges of successive objects in the arriving overlapping stream.

6. Apparatus according to claim 3, wherein a detection device interacts with the displacement means and emits the signal to a counting and/or control device in each case when the displacement means interacts with an object.

7. Apparatus according to claim 3, wherein the position changing device includes a guide means extending in the conveying direction for the displacement means, and the drive of the position changing device includes an endless traction element which is driven so as to circulate at least approximately at the conveying speed of the second conveyor and has catching elements which are arranged one behind another at least approximately at a desired spacing of the objects on the second conveyor and interact with the displacement means in the conveying direction.

8. Apparatus according to claim 7, wherein the displacement means includes at least two displacement elements which are driven alternately in the conveying direction.

9. Apparatus according to claim 3, wherein the displacement means includes a number of displacement elements which are driven so as to circulate along a circular path and whose position can be controlled such that they are moved along the one section of the movement path which extends approximately rectilinearly and at least approximately in the conveying direction.

* * * * *